US009600996B2

(12) United States Patent
Boyd

(10) Patent No.: US 9,600,996 B2
(45) Date of Patent: Mar. 21, 2017

(54) DEVICES AND METHODS FOR PROVIDING MOBILE CELLULAR BEACONS

(71) Applicant: Cellco Partnership, Arlington, VA (US)

(72) Inventor: Michael Edward Boyd, Fort Worth, TX (US)

(73) Assignee: Cellco Partnership, Basking Ridge, NJ (US)

( * ) Notice: Subject to any disclaimer, the term of this patent is extended or adjusted under 35 U.S.C. 154(b) by 203 days.

(21) Appl. No.: 14/076,004

(22) Filed: Nov. 8, 2013

(65) Prior Publication Data

US 2015/0130591 A1 May 14, 2015

(51) Int. Cl.

| | |
|---|---|
| ***G08B 21/10*** | (2006.01) |
| ***G08B 7/06*** | (2006.01) |
| *G08B 27/00* | (2006.01) |
| *G06Q 50/26* | (2012.01) |

(52) U.S. Cl.

CPC ..... *G08B 21/10* (2013.01); *G08B 7/06* (2013.01); *G06Q 50/265* (2013.01); *G08B 27/006* (2013.01)

(58) Field of Classification Search

CPC ..... G08B 21/10; G08B 7/06

USPC ..... 340/8.1

See application file for complete search history.

(56) References Cited

U.S. PATENT DOCUMENTS

| | | | | |
|---|---|---|---|---|
| 8,041,330 | B1 * | 10/2011 | Garin | H04W 4/22 342/386 |
| 2008/0309485 | A1 * | 12/2008 | Raduchel | G08B 21/24 340/540 |
| 2015/0102924 | A1 * | 4/2015 | Soloway | G08B 25/008 340/539.11 |

* cited by examiner

*Primary Examiner* — Omer S Khan

(57) ABSTRACT

Methods and devices are disclosed for providing audible, visual, and tactile alerts detectable by first responders in a geographic region impacted by a mass casualty event, such as a natural disaster or a terrorist attack. In certain aspects, an electronic device of an individual trapped within a damaged structure may establish wireless communications with a mobile cellular site and may receive a request to generate an alert audible to first responders. In response to the request, the electronic device may identify first device settings corresponding to the audible alert, and generate the audible alert in accordance with the obtained first device settings. In certain aspects, the audible alert may enable first responders to identify locations of victims trapped within structures damaged by the mass casualty event.

15 Claims, 9 Drawing Sheets

DEVICES AND METHODS FOR PROVIDING MOBILE CELLULAR BEACONS

BACKGROUND

Technical Field

The present disclosure generally relates to methods and systems for configuring wireless devices using received signals to generate audible, visual, and tactile alerts.

Background

During a natural disaster, such as an earthquake, tsunami, or tornado, a victim's survival depends greatly on the speed at which first responders locate that injured individual within a damaged structure. In these instances, however, the victim may by unable to alert first responders to his or her presence within the damaged structure. For example, a loss of electrical power may prevent the victim from communicating with first responders via convention or wireless communications devices, and further, the victim's injuries may prevent the victim from effectively calling attention to his or her location within the damaged structure. Thus, first responders often spend time and resources searching through a damaged structure to identify trapped victims that would be better spent rescuing and treating the trapped victims.

SUMMARY

The disclosed embodiments include methods and devices that, in response to a message transmitted by a mobile cellular site, generate at least one of an audible alert, a visual alert, or a tactile alert detectable by a first responder. In one embodiment, a method for providing a wireless beacon at an electronic device includes receiving, from a mobile cellular site, a message comprising a first request to generate an audible alert. In response to the received request, the method includes identifying one or more first device settings that establish the audible alert. The method also includes generating the audible alert in accordance with the identified first device settings. In one aspect, the audible alert includes a continuous tone having a frequency detectable by at least one or a human being or a canine.

The disclosed embodiments may also include an electronic device having a storage device and at least one processor coupled to the storage device. The storage device may store software instructions for controlling the at least one processor when executed by the at least one processor. The at least one processor may be operative with the software instructions and may be configured to receive, from a mobile cellular site, a message comprising a first request to generate an audible alert. In response to the received request, the at least one processor may be further configured to identify one or more first device settings that establish the audible alert, and generate the audible alert in accordance with the identified first device settings. In one aspect, the audible alert may include a continuous tone having a frequency detectable by at least one of a human being or a canine.

Additional disclosed embodiments relate to a tangible, non-transitory computer-readable medium storing instructions that, when executed by at least one processor, perform a method for providing a beacon at an electronic device. The method includes receiving, from a mobile cellular site, a message comprising a first request to generate an audible alert. In response to the received request, the method includes identifying one or more first device settings that establish the audible alert. The method also includes generating the audible alert in accordance with the identified first device settings. In one aspect, the audible alert includes a continuous tone having a frequency detectable by at least one or a human being or a canine.

In a further embodiment, a computer-implemented method includes identifying spatial positions of a plurality of wireless devices disposed within a geographic region. In one aspect, the geographic region may be impacted by a mass casualty event. The method also includes obtaining mapping data for the geographic region. The mapping data may indicate a spatial position associated with at least one structure within the geographic region. The method includes determining, using at least one processor, a concentration of individuals within the at least one structure based on the identified spatial positions and the obtained mapping data, and generating, using the at least one processor, at least one of graphic or textual identifying the determined concentration to a first responder.

Additional objects and advantages of the disclosed embodiments will be set forth in part in the description that follows, and in part will be obvious from the description, or may be learned by practice of the invention. The objects and advantages of the disclosed embodiments will be realized and attained by means of the elements and combinations particularly pointed out in the appended claims.

It is to be understood that both the foregoing general description and the following detailed description are exemplary and explanatory only and are not restrictive of the disclosed embodiments as claimed.

The accompanying drawings constitute a part of this specification. The drawings illustrate several embodiments of the present disclosure and, together with the description, serve to explain the principles of the disclosed embodiments as set forth in the accompanying claims.

DETAILED DESCRIPTION OF EMBODIMENTS

Reference will now be made in detail to embodiments of the present disclosure, examples of which are illustrated in the accompanying drawings. Wherever possible, the same reference numbers will be used throughout the drawings to refer to the same or like parts.

In this application, the use of the singular includes the plural unless specifically stated otherwise. In this application, the use of "or" means "and/or" unless stated otherwise. Furthermore, the use of the term "including," as well as other forms such as "includes" and "included," is not limiting. In addition, terms such as "element" or "component" encompass both elements and components comprising one unit, and elements and components that comprise more than one subunit, unless specifically stated otherwise. Additionally, the section headings used herein are for organizational purposes only, and are not to be construed as limiting the subject matter described.

The disclosed embodiments relate to techniques and devices that enable first responders to deploy multi-carrier mobile cellular sites within a geographic region impacted by a mass casualty event, and to broadcast messages that cause registered wireless devices to generate an audible alert, a visual alert, and/or a tactile alert detectable by the first responders. In certain aspects, "mass casualty events" consistent with the disclosed embodiments include, but are not limited to, a natural disaster (e.g., a tornado, an earthquake, a tsunami, a flood, and forest fire), a terrorist attack, an industrial accident, a criminal event, a construction accident, and any additional or alternate incident having a potential to cause injury and trap individuals within structures. Further, in some aspects, a "first responder" may represent a member of a fire department (e.g., a firefighter and a paramedic), a law enforcement officer, a governmental official, an employee of a private security firm, and any additional or alternate individual that searches for and rescues victims of a mass casualty event.

Figure 1:
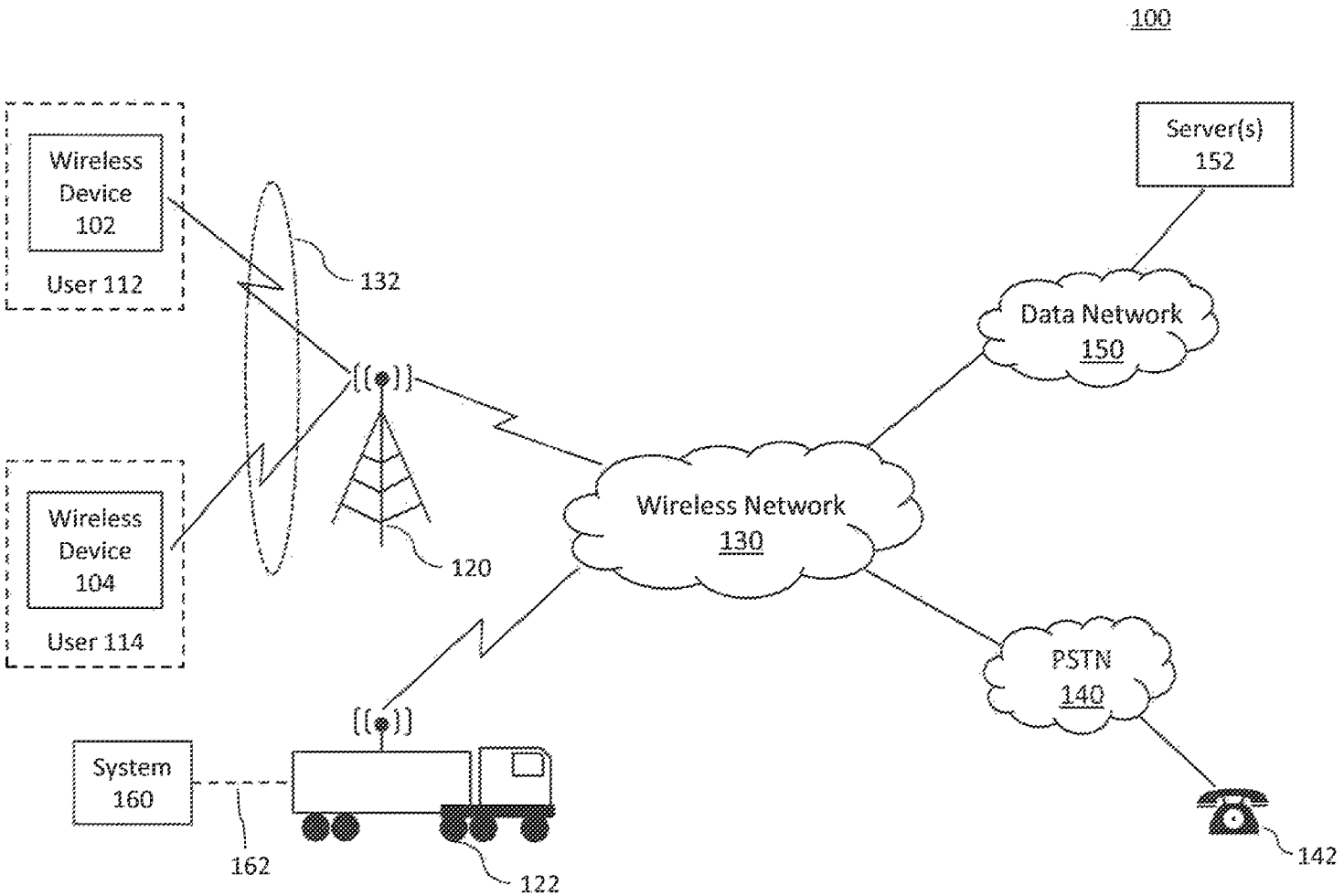
FIG. 1 illustrates an exemplary wireless communications environment, consistent with the disclosed embodiments.

FIG. 1 illustrates an exemplary wireless communication environment 100, consistent with certain disclosed embodiments. In one aspect, environment 100 includes wireless devices 102 and 104, a wireless network 130, and a base station 120 through which devices 102 and 104 access wireless network 130. Environment 100 may also include a public switched telephone network (PSTN) 140 connecting one or more telephone units 142 to wireless network 130, and a data network 150 that facilitates packetized data communication between server 152 and wireless network 130. Further, in some embodiments, environment 100 may also include a multi-carrier mobile cellular site 122 capable of establishing a secondary or backup connection between wireless network 130 and client devices 102 and 104, and a computer system 160 in communication with mobile cellular site 122 across wired or wireless connection 162.

In one embodiment, wireless devices 102 and 104 may represent devices capable of receiving and transmitting data (e.g., voice data, textual data, images, video, or combinations thereof) across wireless network 130. By way of example, wireless device 102 may include a mobile phone, a smart phone, a device wearable by a human being (e.g., a smart watch), a device wearable by an animal (e.g., affixed to a collar), an embedded device, a portable navigation device (e.g., a GPS device), a personal computer, a laptop computer, a tablet computer, a notebook computer, a handheld computer, a set top box, and any additional or alternate computing device operable to transmit and receive data across wireless network 130 through base station 120 and/or mobile cellular site 122. Further, in certain aspects, client devices 102 and 104 may be implemented with one or more processors or computer-based systems capable of executing software instructions to perform processes consistent with the disclosed embodiments.

Further, wireless device 102 (and additionally or alternatively, wireless device 104) may represent one or more wireless communications devices that, in certain embodiments, are associated with a corresponding user. By way of example, wireless device 102 may include a smart phone, mobile telephone, or other mobile telecommunications device associated with user 112, and wireless device 104 may include a smart phone, mobile telephone, or other mobile telecommunications device associated with user 114.

In certain aspects, user 112 may leverage wireless device 102 to initiate and conduct voice communications sessions with components of environment 100 (e.g., telephone units 142 via PSTN 140), transmit and receive data across wireless network 130, and display the received data to user 112. Additionally or alternatively, user 112 may leverage wireless device 102 to initiate and conduct voice communications with components of environment 100 using one or more VOIP protocols. Further, in some embodiments, wireless device 102 may be configured to communicate with a local wireless router using a corresponding local wireless network, such as a WiFi network.

The disclosed embodiments are, however, not limited to wireless devices, such as smart phones, mobile telephones, or other mobile telecommunications devices, that are operable to exchange voice and data communications across wireless network 130. In some embodiments, one or more of wireless devices 102 and 104 may represent a wireless device capable of registering with base station 120 or mobile cellular site 122, receiving messages broadcast to devices disposed within specific geographic ranges (e.g., within range of base station 120), and generating an audible and/or visual alert in response to the received message.

Wireless network 130 may include components to implement a core network associated with one or more analog and digital wireless communications standards and protocols. For example, wireless communications standards and protocols consistent with the disclosed embodiments include, but are not limited to, 2G, 3G, 4G, LTE, Mobile WiMax, GSM, PCS, and Evolution-Data Optimized (EV-DO) wireless communications standards. Further, in an embodiment, wireless network 130 may include a plurality of wireless communications networks, which may be associated with corresponding wireless service providers and corresponding core network components. The components of the core network or networks of wireless network 130 may, in some embodiments, be connected using wired or wireless connections that leverage Internet Protocol (IP) communications.

In certain embodiments, base station 120 and/or mobile cellular site 122 may provide wireless communications services to registered wireless communications devices (e.g., wireless devices 102 and 104) within a corresponding geographic region. In one aspect, wireless device 102 may monitor a strength of a signal broadcasted by base station 120, and may establish communications and "register" with base station 120 using one or more registration protocols consistent with the wireless communications standards and protocols implemented by wireless network 130.

Upon completion of the registration process, base station 120 may provide a wireless access network 132 that connects subscribers at wireless devices 102 and 104 (e.g., user 112 and 114) to corresponding wireless service providers associated with wireless network 130. By way of example, wireless access network 132 may correspond to a 2G network, a 3G network, a 4G network, a LTE network, a Mobile WiMax network, an extended WiFi network, and any additional or alternate network capable of connecting subscribers to service providers within environment 100. Further, although not illustrated in FIG. 1, mobile site 122 may also provide wireless communications services to registered wireless communications devices (e.g., wireless devices 102 and 104) within a corresponding geographic region using processes similar to those described above in reference to base station 130.

In some embodiments, wireless network 130, in conjunction with base station 120 and wireless access network 132, enable user 112 to initiate and receive voice communications and data communications (e.g., SMS, EMS, and MMS text messaging) with other mobile devices across wireless network 130. Further, and consistent with the disclosed embodiments, user 112 may also leverage wireless device 102 to initiate and receive voice communications with users of telephone units 142 through PSTN 140, and additionally or alternatively, with other components of environment 100 using VOIP protocols.

Additionally, in certain embodiments, wireless network 130, in conjunction with base station 120 and wireless access network 132, enable user 112 to transmit data to and receive data from server 152 across data network 150. In one aspect, data network 150 may interface with wireless network 130 using a corresponding gateway system (not shown) that is capable of executing instructions to perform processes consistent with the disclosed embodiments.

Data network 150 may include one or more communication networks or medium of digital data communication. Examples of data network 150 include a local area network ("LAN"), a wireless LAN, a RF network, a Near Field Communication (NFC) network, a wireless LAN (e.g., a "WiFi" network), a wireless Metropolitan Area Network (MAN) connecting multiple wireless LANs, NFC communication link(s), and a wide area network ("WAN"), e.g., the Internet. Consistent with embodiments of the present disclosure, data network 150 may include the Internet and any publicly accessible network or networks interconnected via one or more communication protocols, including, but not limited to, hypertext transfer protocol (HTTP) and transmission control protocol/internet protocol (TCP/IP). Communications protocols consistent with the disclosed embodiments also include protocols facilitating data transfer using radio frequency identification (RFID) communications and/or NFC.

Server 152 may include one or more server and computing devices that provide information to one or more other components of environment 100. In one embodiment, server 152 may include a general-purpose computer (e.g., a personal computer, network computer, server, or mainframe computer) having one or more processors that may be selectively activated or reconfigured by a computer program. In one aspect, server 152 may be configured to provide one or more websites associated with a wireless service provider, a content provider, an electronic or e-commerce retailer, a financial institution, and the like. For example, upon request from a wireless device (e.g., wireless device 102), server 152 may be configured to provide information associated with a requested web page to wireless device 102, which may render the received information and present the web page to user 112.

Additionally, server 152 may be incorporated as a corresponding node in a distributed network, and additionally or alternatively, as a corresponding networked server in a cloud-computing environment. Furthermore, server 152 may communicate via data network 150 with one or ore additional servers (not shown), which may facilitate the distribution of processes for parallel execution by the additional servers.

System 160 may represent one or more computer systems associated with mobile cellular site 122. In one embodiment, system 160 may include one or more processors coupled to corresponding random access memories (RAMs) and tangible, non-transitory storage media, such as hard disks and flash drives. Further, in some embodiments, system 160 may communicate with mobile cellular site 122 across wired or wireless connection 162.

In one embodiment, system 160 may include an additional wireless device in direct with mobile cellular site 122 across wired or wireless connection 162, or alternatively, in communication with mobile cellular site 122 through one or more intermediate computing systems (e.g., through a wireless router via a WiFi connection). By way of example, the additional wireless device may include, but is not limited to, a smartphone, a mobile telephone, a tablet computer, and a wearable computing device (e.g., a smart watch.

In certain aspects, and after deployment of mobile cellular site 122, one or more first responders may access system 160 and provide instructions to mobile cellular site 122 to establish communications with and "register" wireless devices disposed within a geographic region impacted by a mass casualty event. Further, using system 160, the first responders may broadcast a message (e.g., a "beacon" message) to the registered wireless devices instructing the registered wireless devices to generate audible, visual, and/or tactile alerts detectable by the first responders. In other aspects, the first responders may use system 160 to identify spatial positions of individuals trapped in damaged structures, to identify one or more of the damaged structures as an initial focus of search and rescue operations, and further, to identify a "roadmap" of damaged structures for subsequent search and rescue operations.

Further, although environment 100 is illustrated in FIG. 1 with wireless devices 102 and 104, that the disclosed embodiments may include a plurality of wireless devices. Similarly, although computing environment 100 is illustrated in FIG. 1 with a single base station 130, a single mobile cellular site 122, a single PSTN 140, a single telephone unit 142, a single data network 150, and a single server 152, persons of ordinary skill in the art will recognize that environment 100 may include any number of additional number of base stations 130, mobile cellular sites 122, PSTNs 140, telephone units 142, data networks 150, and servers 152.

Figure 2:
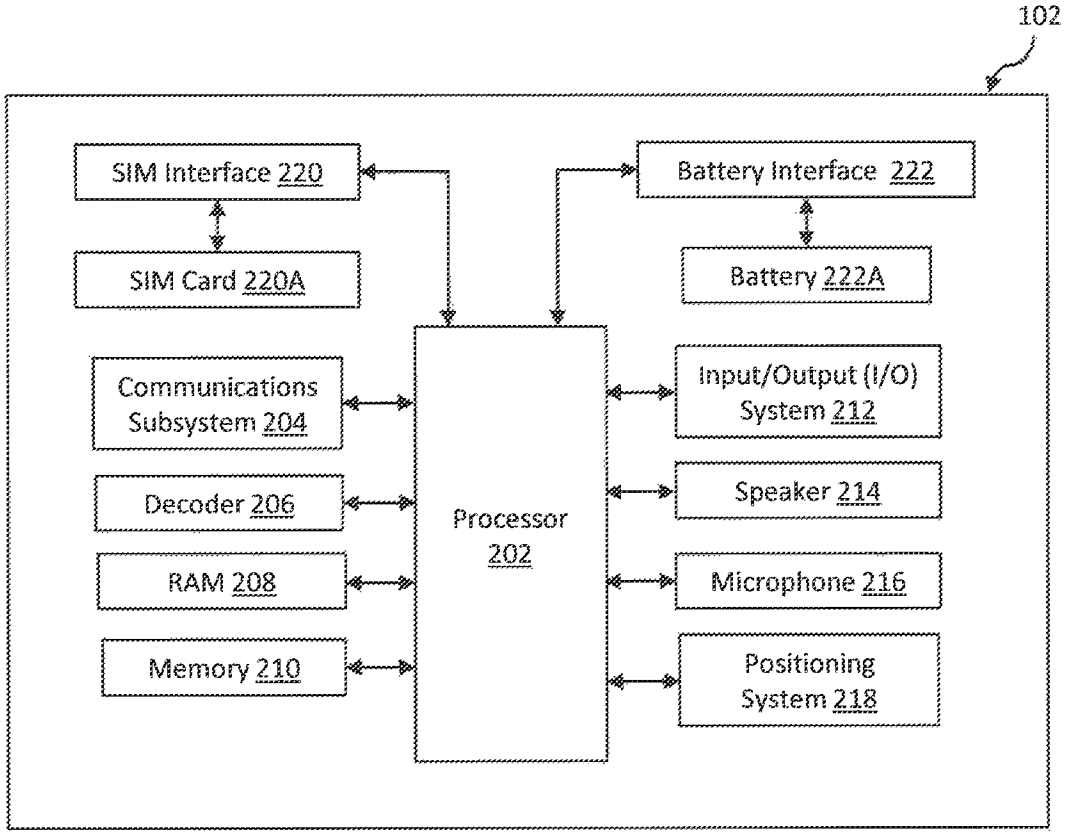
FIG. 2 is a diagram of an exemplary wireless device, consistent with the disclosed embodiments.

FIG. 2 is a block diagram of an exemplary wireless device 102 operable to transmit and receive data across a wireless communications network (e.g., wireless network 130 of FIG. 1), in accordance with the disclosed embodiments. As described above, wireless device 102 may establish communications with a base station (e.g., base station 120) and/or a mobile cellular site (e.g., mobile cellular site 122), and may subsequently transmit and receive voice and data communications across wireless network 130.

In an embodiment, wireless device 102 may represent a computer-based device that includes a processor 202 controlling an overall operation of wireless device 102. Communication functions, including data and voice communications, may be performed through a communication subsystem 204 operable to receive and transmit data across wireless network 130 via base station 120 (and/or mobile site 122). Wireless device 102 may also include a decoder 206 that decompresses and decrypts data received by communications subsystem 204. In some embodiments, wireless device 102 may represent a battery-powered device, and may include a battery interface 222 for receiving a corresponding battery 222A.

In FIG. 2, processor 202 may be coupled to and can interact with a random access memory (RAM) 208 and a memory 210 that includes, but is not limited to, a hard drive, CD, DVD, flash memory, or a similar storage device. Processor 202 may also be coupled to an input/output (I/O) subsystem 212, a speaker 214, and a microprobe 216. In one embodiment, I/O subsystem 212 may include an interface facilitating interaction between a user (e.g., user 112) and wireless device 102. User interfaces consistent with the disclosed embodiments include, but are not limited to, a touchscreen configured to display content to and receive input from user 112, a display unit, a physical keyboard, an optical tracking device, and/or a mechanical tracking device, such as a trackball.

Further, in other embodiments, I/O subsystem 212 may include a visual indicator unit controllable by processor 202 to indicate a status of one or more subsystems of and applications executed by wireless device 102. By way of example, visual indicator units consistent with the disclosed embodiments include, but are not limited to, one or more LEDs, one or more incandescent lamps, one or more fluorescent lamps, and combinations thereof.

In additional embodiments, I/O system 212 may include a data port that may communicatively couple wireless device 102 to an external device or storage medium. By way of example, data ports consistent with the disclosed embodiments may support a universal serial bus (USB) connection, a mini-or micro-USB connection, a FireWire connection, and any additional or alternate connection appropriate to wireless device 102. Additionally or alternatively, I/O system 212 may include a Bluetooth communication subsystem, a NFC subsystem, and any additional or alternate subsystem facilitating short-range communication between proximate devices.

Processor 202 may, in some embodiments, interact with a positioning subsystem 218 for determining a spatial position of wireless device 102. The location may be determined in any number of ways, such as by a computer, by a Global Positioning System (GPS), either included or not included in wireless device 102, through a Wi-Fi network, through triangulation based on interaction with a number of base stations and mobile sites, and/or by having a location entered manually.

In some embodiments, to identify user 112, processer 202 may leverage a Subscriber Identity Module or a Removable User Identity Module (SIM/RUIM) card 220A inserted into a SIM/RUIM interface 220 for communication with a wireless network, such wireless network 130 and/or wireless access network 132. Alternatively, user identification information can be programmed into memory 210.

Wireless device 102 may also include an operating system and programs that are executed by processor 202 and are typically stored in memory 210. Additional applications can be loaded onto wireless device 102 through wireless network 130, through components of I/O subsystem 212, such as a data port or short-range communications subsystem, or any other suitable subsystem of wireless device 102.

In certain embodiments, communication subsystem 204 may receive data transmitted across wireless network 130. The received data may include, but is not limited to, a text message, an email message, an instant message, or a requested web page. Decoder 206 may decompress, and when appropriate, decrypt the received data, which may be provided to processor 202. Processor 202 further processes information associated with the decompressed and decrypted data for presentation to a user via a touchscreen or display unit of I/O subsystem 212, via speaker 214, or by combinations thereof.

In other embodiments, communications subsystem 204 may receive a message broadcasted simultaneously across wireless network 130 to multiple wireless devices disposed within a specified geographic region. For example, an emergency management agency associated with the Federal government, a state government, or a local government may leverage cell broadcast (CB) protocols to push a message to all wireless devices registered to a base station servicing a geographic region impacted by a natural disaster or emergency event. In one aspect, the message may correspond to a wireless emergency alert (WEA) issued by the National Weather Service to warn individuals within a specific town or county of a nearby tornado. In additional aspects, the WEA message may be issued by a local police department and may alert individuals within certain geographic regions of a missing child (e.g., an Amber Alert). Alternatively, for example, the WEA message may be issued by an employer or an academic institution and may warn employees or students of an emergency event on a corresponding campus.

Although WEA messages may alert individuals to a natural disaster or other mass casualty event impacting a particular geographic region, first responders to the impacted geographic region often possess limited knowledge of the number or location of trapped and incapacitated individuals within the impacted geographic region. For example, after sheltering-in-place during a natural disaster, an individual may be trapped in a partially collapsed building and may require rescue by the first responders. A loss of power in the impacted geographic region may prevent the individual's wireless device from establishing communications with a corresponding base station. Further, the loss of network connectivity may reduce an operability of a positioning subsystem incorporated within the individual's wireless device. The first responders thus rarely have concrete information on the locations of trapped individuals within the impacted geographic region, and the search and rescue operations may require a time-consuming search of a collapsed or partially collapsed structure to locate victims.

In an embodiment, first responders within a geographic region affected by a mass casualty event (e.g., a natural disaster or a terrorist attack) may leverage cell broadcast (CB) technologies to broadcast a message that, upon receipt by registered wireless devices, causes the registered wireless devices to generate an audible, visual, and/or tactile alert recognizable by the first responders. For example, first responders may deploy one or more multi-carrier mobile cellular sites (e.g., mounted on or inside a semi-trailer) at locations proximate to an epicenter of the mass casualty event. First responders may then configure the multi-carrier mobile cellular sites to broadcast a "beacon" message to the registered wireless devices within the geographic region using cell broadcast (CB) technologies.

Upon receipt of the beacon message, and as described below in reference to FIG. 3, the registered wireless devices may continuously emit an audible, visual, and/or tactile beacon that alerts first responders to locations of the wireless devices within the impacted geographic region. As users often maintain their wireless devices in close proximity to their bodies, the location of the wireless devices may enable first responders to better identify the locations of trapped individuals and direct search and rescue operations within the impacted geographic region.

Figure 3:
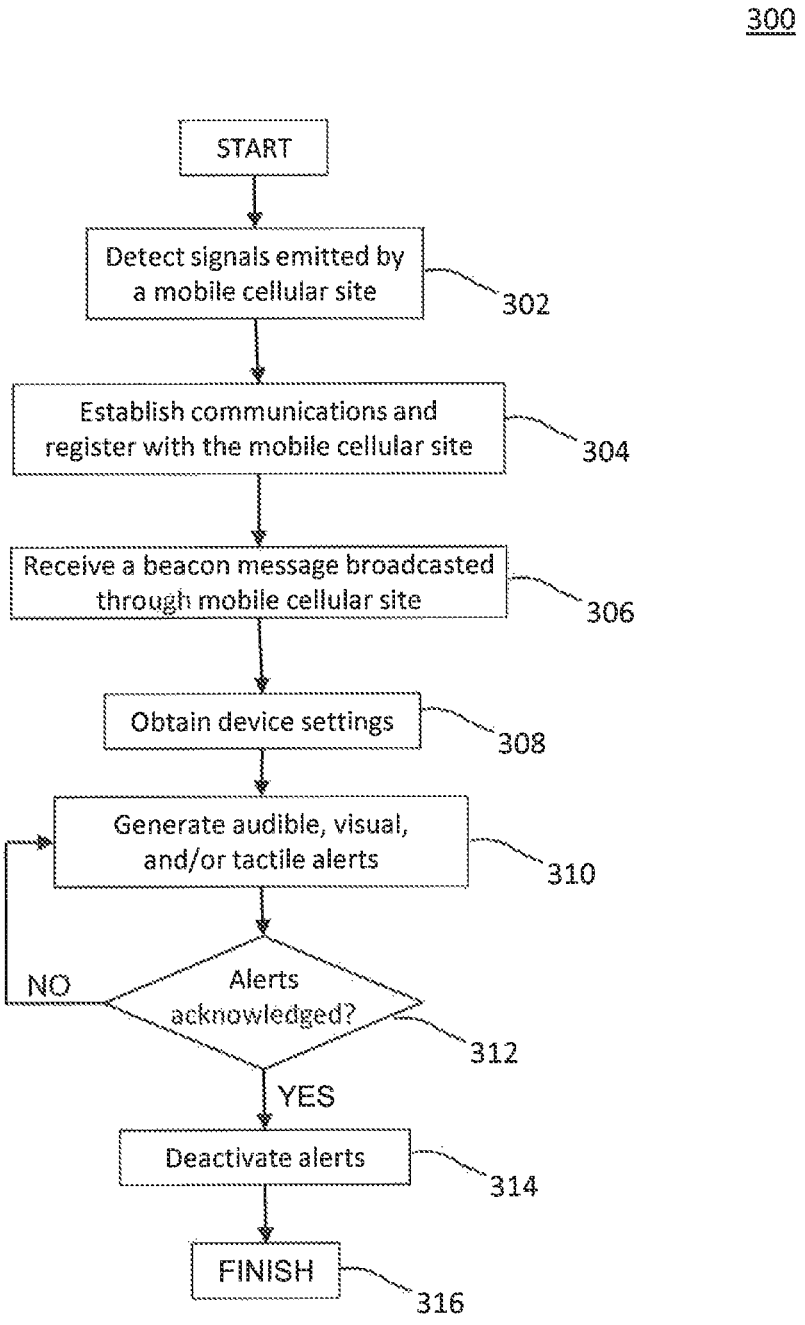
FIG. 3 is a flow diagram of an exemplary method for providing cellular beacons within a geographic region, consistent with the disclosed embodiments.

FIG. 3 is a flowchart of example method 300 for providing cellular beacons within a geographic region, in accordance with disclosed embodiments. Exemplary method 300 provides functionality that, in an embodiment, enables a wireless device of a user (e.g., wireless device 102 of user 112) to establish communications within a mobile cellular site disposed within a geographic region, and further, to generate an audible, visual, and/or tactile alert in response to a received message from the mobile cellular site. In certain embodiments, the generated alerts enable first responders to pinpoint a location of user 112, thereby prioritizing rescue operations within the target geographic region.

In step 302, wireless device 102 may detect a wireless control signal emitted by a mobile cellular site (e.g., mobile cellular site 122). In an embodiment, mobile cellular site 122 may be deployed by the first responders at a location proximate to an epicenter of a mass casualty event in the geographic region. Further, in certain aspects, wireless device 102 may be disposed proximate to user 112, who may be trapped in a damaged structure located within the geographic region. By way of example, the mass casualty event may include, but is not limited to, a natural disaster (e.g., an earthquake, a tornado, a flood, a tsunami, and a forest fire), a terrorist attack, and an industrial accident occurring within the geographic region.

In step 304, and based on the detected strength of signal, wireless device 102 may establish communications and "register" with mobile cellular site 122. In an embodiment, wireless device 102 may initiate the registration process with mobile cellular site 122 when the strength of the emitted signal exceeds a threshold value. Further, in certain aspects, a processor of wireless device 102 (e.g., processor 202) may execute software instructions to perform the registration process in accordance with a corresponding registration protocol. By way of example, the registration protocol may be predefined by a wireless service provider associated with wireless device 102 and/or a manufacturer of wireless device 102, and information identifying the predefined registration protocol may be stored within a memory of wireless device 102 (e.g., memory 210). Alternatively, the corresponding mobile cellular site may transmit a control message to wireless device 102 that includes information identifying the registration protocol, and wireless device 102 may parse the control message to extract the protocol information.

Referring back to FIG. 3, wireless device 102 may receive data broadcasted by mobile cellular site 122 in step 306. By way of example, and as described herein, first responders may generate a message using system 160, which mobile cellular site 122 may broadcast to each registered wireless device using cell broadcast (GB) protocols. In an embodiment, a communications subsystem of wireless device 102 (e.g., communications subsystem 204) may receive the data from mobile cellular site 122, and a corresponding decoder (e.g., decoder 206) may decompress and if necessary, decrypted the received data.

In an embodiment, the data received in step 306 may include a "beacon" message specified by the first responders and transmitted by mobile cellular site 122. In an embodiment, the beacon message may include a request or instruction that causes client device 102 to generate at least one of an audible, visual, or tactile alert detectable by the first responders. Further, in certain aspects, processor 202 of wireless device 102 may identify the beacon message within the received data based on an identifier associated with the beacon message (e.g., as included in header of the received data), based on information included within the body of the beacon message, and additionally or alternatively, based on an expected size or structure of the beacon message.

Upon receipt of the beacon message in step 306, processor 202 may obtain device settings corresponding to the audible, visual, and/or tactile alerts in step 308. In one embodiment, at least a portion of the device settings may be "standard" settings specified by a wireless services provider associated with wireless network 130 and/or a manufacturer of wireless device 102. By way of example, memory 210 of wireless device 102 may store information identifying these "standard" device settings, and processor 202 may obtained the stored information in step 308. In other embodiments, one or more of the device settings may be specified by the first responders using system 160, and information identifying these specified device settings may be incorporated into a portion of the beacon message. Processor 202 may parse the received beacon message and extract information identifying the specified device settings in step 308.

In certain aspects, the beacon message may request or instruct wireless device 102 to generate an audible alert that may be recognized by the first responders. For example, the audible alert may include a tone continuously emitted by a speaker of wireless device 102 (e.g., speaker 214). In some embodiments, processor 102 may obtain device settings in step 306 that establish a device volume associated with the continuous tone (e.g., a maximum volume of wireless device 102), and further, may establish a frequency or set of frequencies at which speaker 214 emits the continuous tone.

For example, as described herein, the first responders may specify in the beacon message that wireless device 102 emits a continuous high-pitched tone, or a continuous tone mimicking a police or fire department siren. Additionally or alternatively, the first responders may specify in the bacon message that that wireless device 102 emit, in alternating thirty second intervals, a first tone audible to the first responders and a second tone audible only the canines that accompany the first responders.

In additional aspects, the beacon message may also request or instruct wireless device 102 to generate a visual alert recognizable to the first responders. By way of example, the visual alert may represent a flashing of a touchscreen, display unit, and/or visual indicator unit of wireless device 102 (e.g., a touchscreen, display unit, and or visual indicator unit included within I/O subsystem 212) at a predetermined frequency. In some embodiments, the predetermined frequency may specified by the obtained device settings, and processor 202 may generate the visual alert by successively powering-on and powering-off the touchscreen or display unit at the predetermined frequency.

Further, in certain aspects, the beacon message may also request or instruct wireless device 102 to generate a tactile alert recognizable by the first responders. For example, the tactile alert may correspond to a vibration of wireless device 102, and processor 202 may obtain device settings in step 308 that establish a continuous or periodic nature of the vibration.

Referring back to FIG. 3, in step 310, wireless device 102 may generate the audible alerts, and additionally or alternatively, the visual and/or tactile alerts, in accordance with the obtained device settings. For example, as described herein, processor 202 may instruct speaker 214 to emit in step 310 a continuous, high-pitched tone at maximum device volume. Additionally, in certain aspects, processor 202 may instruct I/O subsystem 212 in step 314 to power-on and power-off a touchscreen or display unit at periodic intervals, and further, to vibrate wireless device 102 continuously or at periodic intervals. In some embodiments, wireless device 102 may continue to present the audible, visual, and/or tactile alerts until a power supply of wireless device 102 fails, or alternatively, until user 112 or a first responder acknowledges the presented alert or alerts.

Further, in an embodiment, processor 102 may override one or more user-specified device settings in step 310 to establish the audible, visual, and/or tactile alerts. For example, the user-specified device settings may indicate that wireless device 102 operates in "silent" mode (e.g., without presentation of audible or tactile alerts), and processor 202 may modify the user-specified device settings to generate the audible, visual, and/or tactile alerts in accordance with the obtained device settings.

In step 312, wireless device 102 determines whether an individual (e.g., user 112 and/or one of the first responders) acknowledged the generated audible, visual, and/or tactile alerts. For example, first responders may recognize the audible alert generated by wireless device 102, and may direct resources to locate user 112 within a damaged structure. Once the first responders locate wireless device 102 and user 112, the first responders may acknowledge the audible alert by depressing a power button associated with wireless device 102, by entering one or more keystrokes into a touchscreen or keyboard of wireless device 102, by speaking a combination of words (e.g., "Deactivate") into microphone 216, or through any additional or alternate technique appropriate to wireless device 102.

If processor 202 determines that the audible, visual, and/or tactile alerts have not been acknowledged in step 312, exemplary method 300 passes back to step 312, and wireless device 102 may continue to present the audible, visual, and/or tactile alerts to the first responders.

Alternatively, if processor 202 determines in step 312 that one of the first responders acknowledged the audible, visual, and/or tactile alerts, processor 202 may deactivate the generated alerts in step 314. In certain embodiments, and upon deactivation of the alerts, wireless device 102 may resume a prior operational state (e.g., the "silent" mode described herein). Exemplary method 300 is then complete in step 316.

In certain aspects, as described herein, first responders to a mass casualty event may deploy multi-carrier mobile cellular sites to establish wireless communications with wireless devices (e.g., mobile telephone and smart phones) held proximate to trapped individuals, and to transmit signals to the wireless devices to activate a beacon functionality of the wireless devices. By way of example, the mass casualty event may result from a natural disaster impacting a particular geographic region (e.g., a tornado striking a municipality) that leaves many individual trapped and or incapacitated within collapsed structures. In some embodiments, the activation of the beacon functionality may reduce the time needed by the first responders to identify victims within damaged and/or collapsed buildings, thereby increasing the time available to first responders to rescue and treat the identified victims.

Figure 4A:
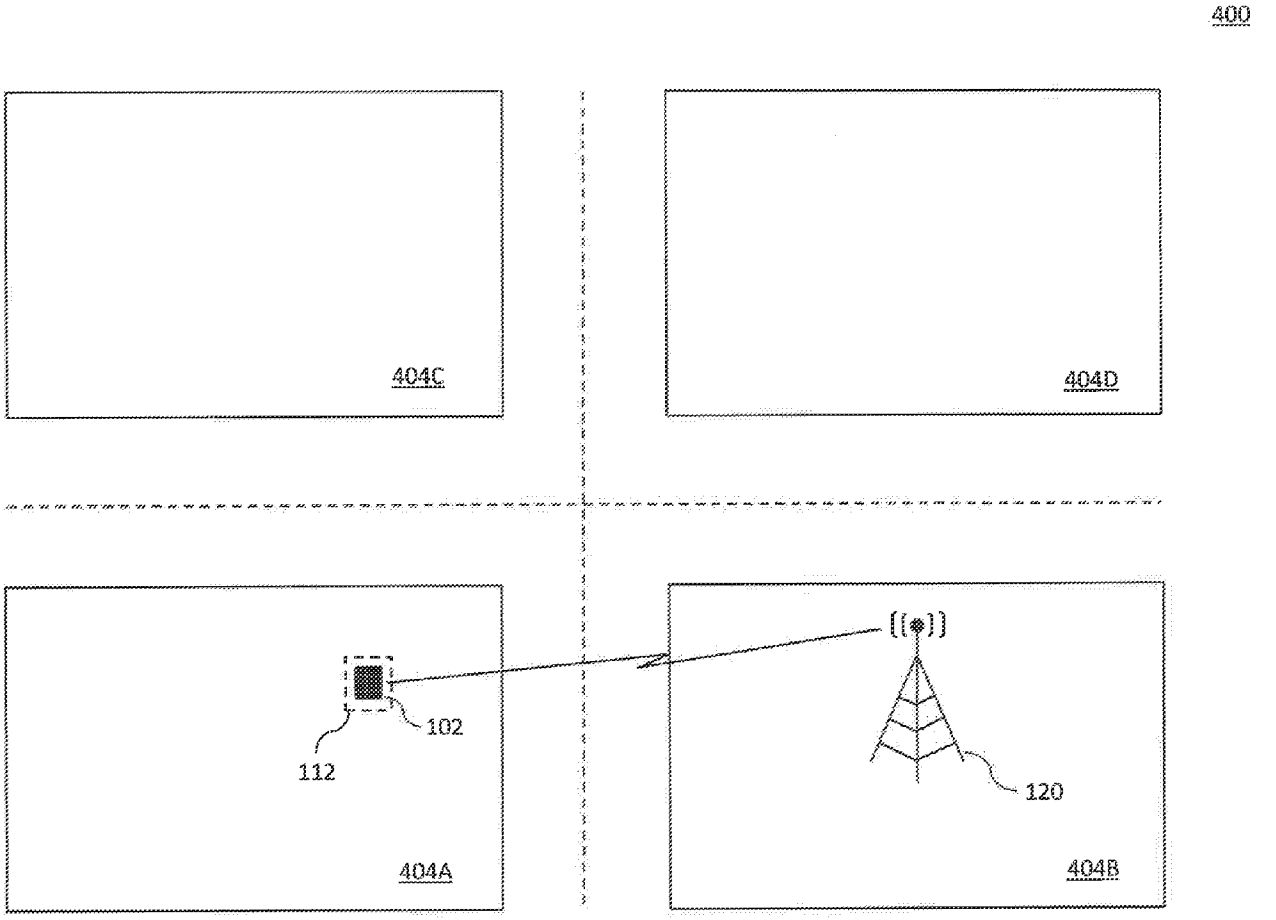
FIGS. 4A-4D illustrate exemplary processes for activating a cellular beacon within a geographic region, consistent with the disclosed embodiments.

FIGS. 4A-4E illustrate processes for activating a cellular beacon within a geographic region impacted by natural disaster, in accordance with disclosed embodiments, For example, as illustrated in FIG. 4A, a user of wireless device 102 (e.g., user 112) may be located in an office within building 404A, and user 112 may access a wireless network (not shown) through wireless device 102 registered with base station 120.

In an embodiment, wireless device 102 may receive a message from the National Weather Service (e.g., a WEA message transmitted in accordance with cell broadcast (CB) protocols) alerting user 112 that a tornado is quickly approaching a geographic region 400 that includes buildings 404A, 404B, 404C, and 404D. In response to one or more emergency protocols (e.g., established by the place of employment), user 112 may seek shelter from the tornado within a designated portion of building 404A. Due to the intensity of the tornado, however, a portion of building 404A may collapse and trap user 112. Further, the tornado may damage one or more components of an electrical distribution network, and a loss of electrical power at base station 120 may prevent wireless device 102 from continuing wireless communications through base station 120.

Figure 4B:
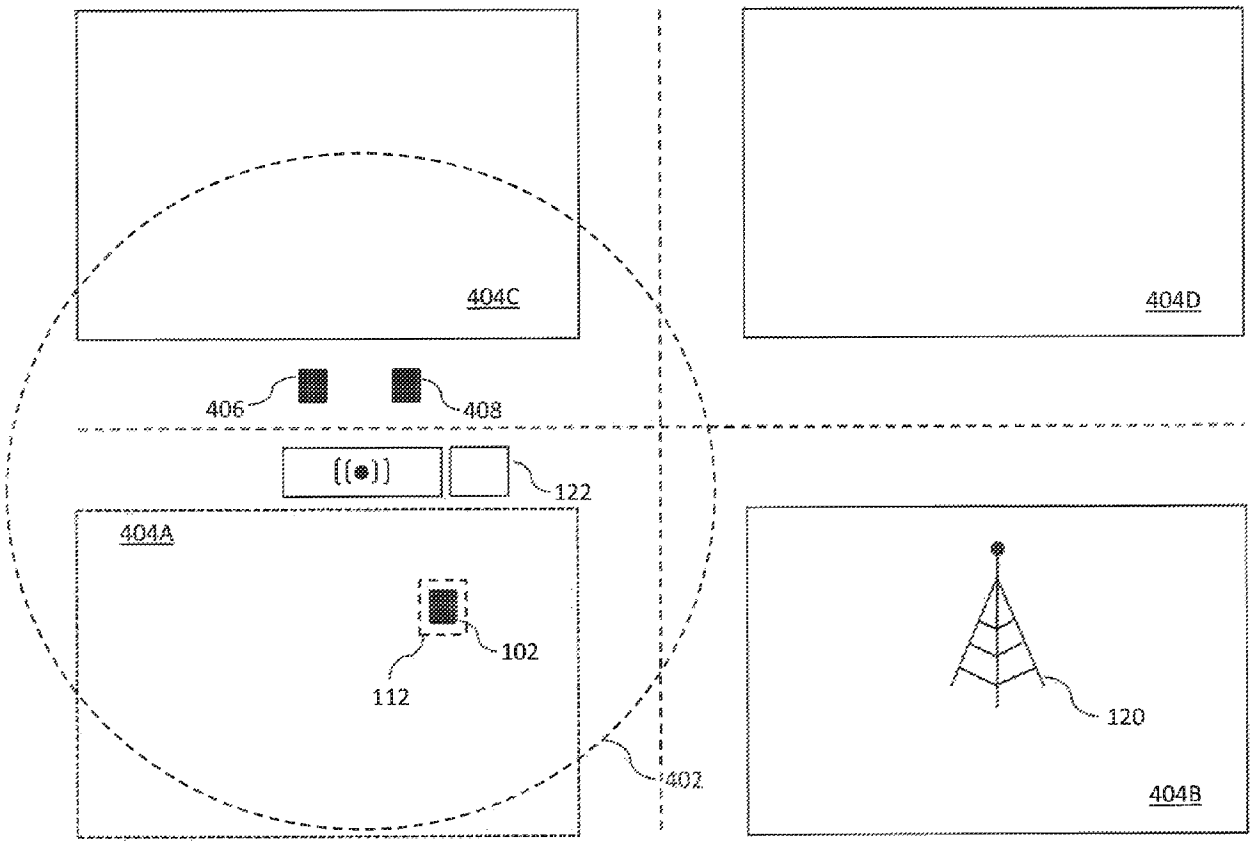

As described herein, fire department personnel, police, and other first responders to partially collapsed building 404A may deploy one or more multi-carrier mobile cellular sites in a vicinity of partially collapsed building 404A in an attempt to activate a beacon functionality of wireless device 102 (and further, similar beacon functionalities of other wireless devices located near trapped individuals). For example, as illustrated in FIG. 4B, first responders may deploy mobile cellular site 122, which may be mounted onto a semi-trailer or flatbed truck, along a street next to partially collapsed building 404A. In an embodiment, the first responders may activate mobile cellular site 122, which may continuously broadcast a control signal within a portion 402 of geographic region 400 that includes partially collapsed building 404A.

Figure 4C:
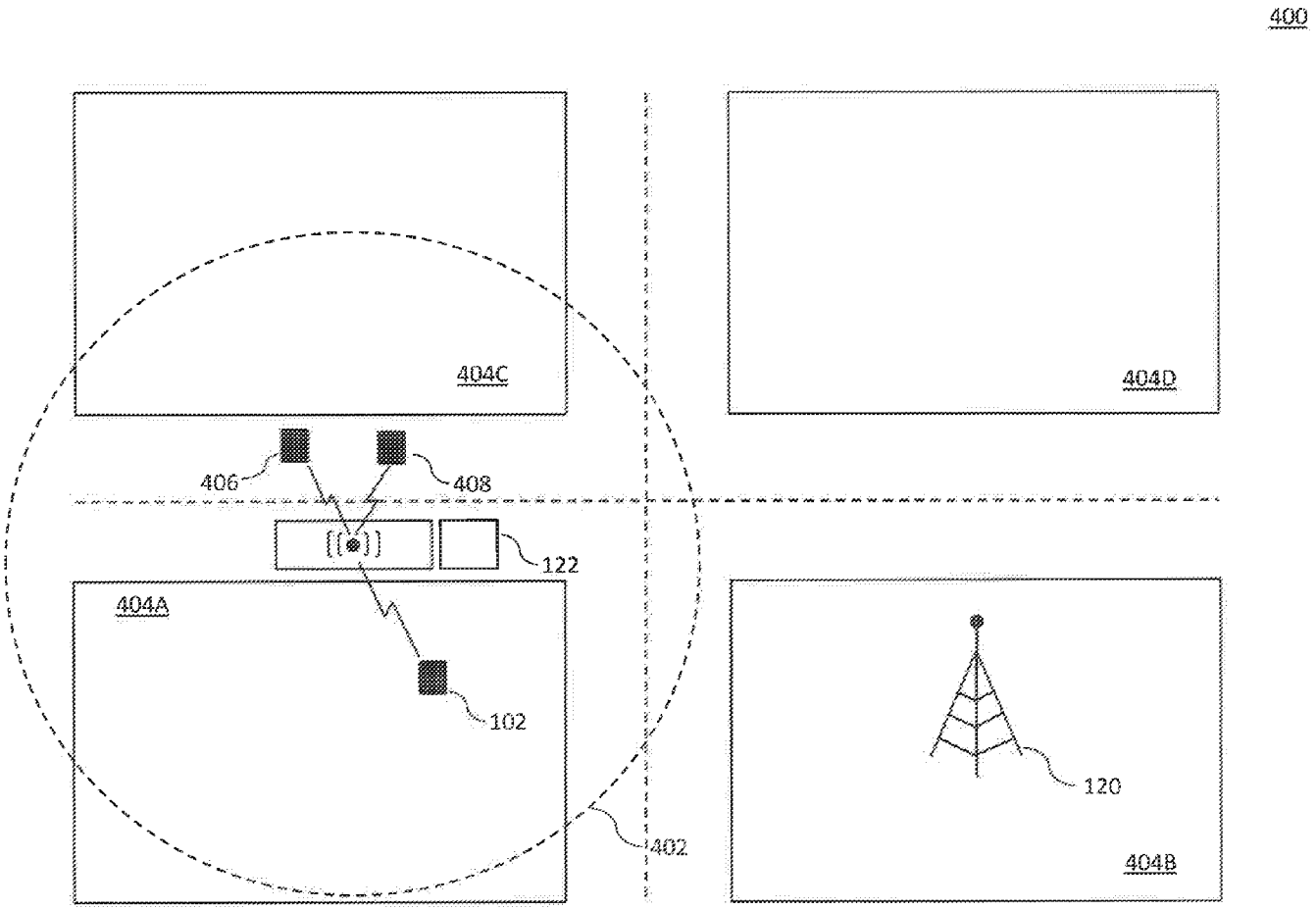

Due to a strength of the broadcasted control and a proximity of mobile cellular site 122, wireless device 102, other wireless communications devices located within partially collapsed building 404A, and further, wireless communications devices 406 and 408 carried by the first responders, may establish communication and register with mobile cellular site 122, as depicted in FIG. 4C. In certain aspects, wireless device 102, first responder devices 406 and 408, and other wireless communications devices within portion 402 may register within mobile cellular site 122 using a registration protocol associated with a device manufacturer, a wireless service provider, and/or corresponding wireless network.

In an embodiment, the first responders may configure mobile cellular site 122 to broadcast a beacon message to each of the registered wireless devices within portion 402. The mobile cellular site 122 may broadcast the beacon message in accordance with cell broadcast (CB) protocols, and may "push" the beacon message to each of the registered devices automatically and without user interaction. As described herein, the registered wireless devices may receive the beacon message, and may obtain one or more device settings associated with audible, visual, and/or tactile alerts identified within the received beacon message.

Figure 4D:
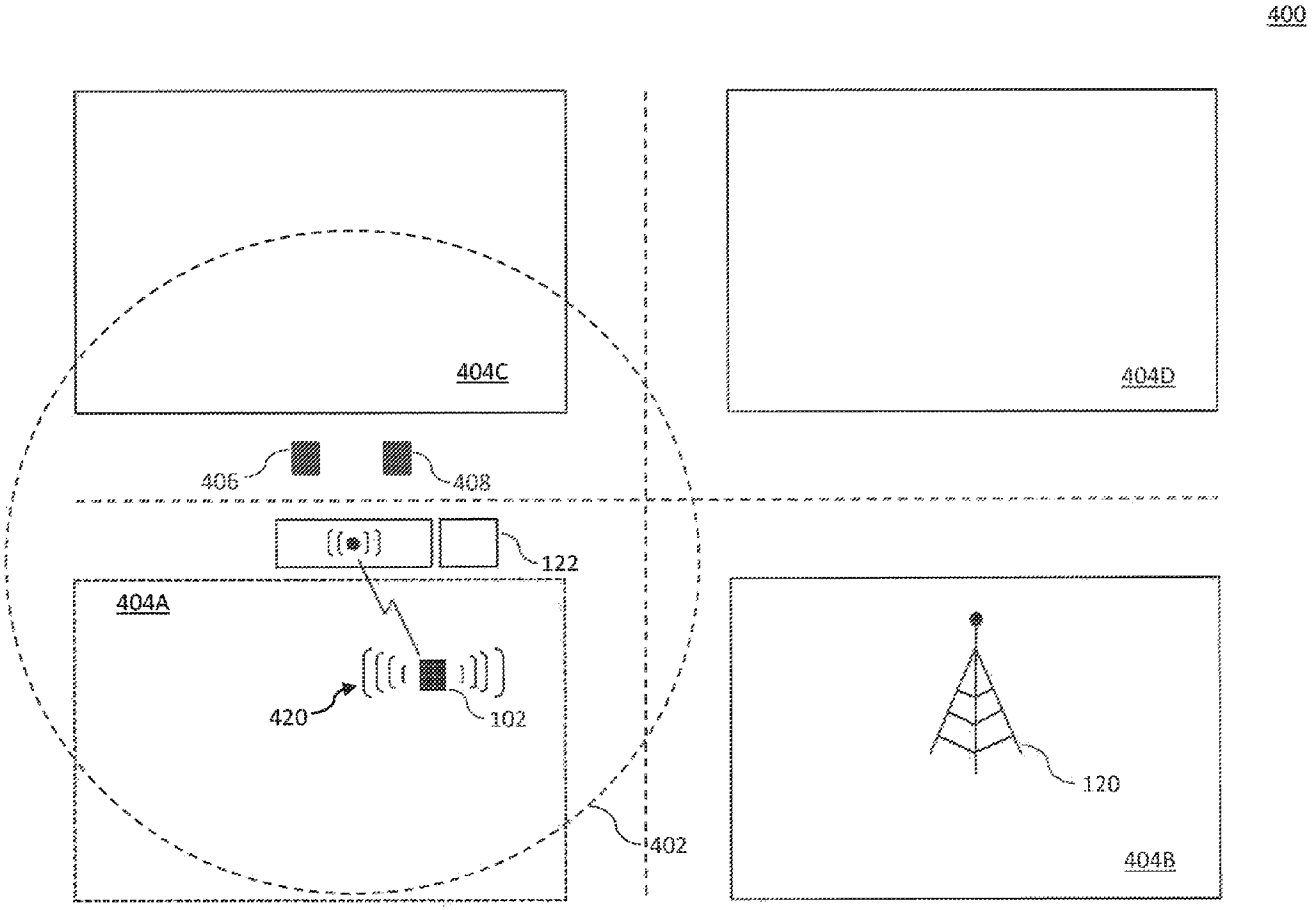

In certain aspects, wireless device 102 may adjust one or more user-specified device settings to conform with the obtained device settings, and may generate and present the audible, visual, and/or tactile alerts (e.g., alert 420) to first responders, as illustrated in FIG. 4D. In one embodiment, alert 420 represents an audible alert that includes a tone emitted continuously by wireless device 102 at a maximum device volume and a predetermined frequency. In other embodiments, as described herein, alert 420 may also include one or more of a visual alert (e.g., a periodic flashing of a touchscreen, a display unit, and/or a visual indicator unit of wireless device 102) and a tactile alert (e.g., a periodic vibration of wireless device 102). Further, although not depicted in FIG. 4D, other registered wireless devices associated with other individuals trapped in partially collapsed building 404A, and additionally or alternatively, individuals trapped in other buildings within geographic region 400, may generate and present similar audible, visual, and/or tactile alerts recognizable by the first responders.

Additionally, wireless devices 406 and 408 of the first responders, which also receive the beacon signal, may generate and present audible, visual, and/or tactile alerts similar to alert 420. In some embodiments, the presentation of alerts by wireless devices 406 and 408 may distract the first responders from those alerts presented by wireless device 102, and may make it difficult to identify the trapped individuals within partially collapsed building 404A. Thus, in certain aspects, the first responders may be instructed to disable their personal wireless devices (e.g., wireless devices 406 and 408) prior the broadcast of the beacon message, and additionally or alternatively, to acknowledge and deactivate any alert upon presentation.

Using the audible, visual, and/or tactile beacon alerts, the first responders may concentrate their search and rescue efforts on certain portions of partially collapsed building 404A that are likely to include trapped individuals. In some embodiments, the concentration of search and rescue efforts in particular portions of partially collapsed building 404A may reduce a time necessary to locate injured occupants, thereby increasing a time available to rescue the injured occupants and provide medical attention. In certain embodiments, the increased time available to rescue efforts may reduce a mortality of trapped occupants in partially collapsed building 404A.

Further, as described herein, first responders may leverage cell broadcast (CB) protocols to push messages that, upon receipt by wireless devices (e.g., wireless device 102), cause the wireless devices to override one or more user-specified device settings and present alerts audible and/or visible to the first responders. In certain aspects, wireless device 102 may represent a smart phone, mobile telephone, or other mobile telecommunications device capable of transmitting and receiving data and/or voice communications across wireless network 130. As many users possess smart phones, mobile telephones, or mobile telecommunications devices similar in functionality to wireless device 102, the disclosed embodiments enable these users to possess a cellular "man-down" beacon without requiring a purchase of an additional device.

However, many individuals vulnerable during a mass casualty event fail to regularly carry smart phones, mobile telephones, or mobile telecommunications devices similar to wireless device 102. For example, children attending public and private schools may be prohibited from carrying mobile communications devices onto school property. Similarly, due to illness or incapacity, patients in hospitals, nursing homes, and hospices may not possess or may not be able to utilize a smart phone, mobile telephone, or mobile telecommunications device similar in functionality to wireless device 102. Further, prisoners jails and prisons are prohibited from possessing any mobile communications devices during their incarceration.

Figure 5:
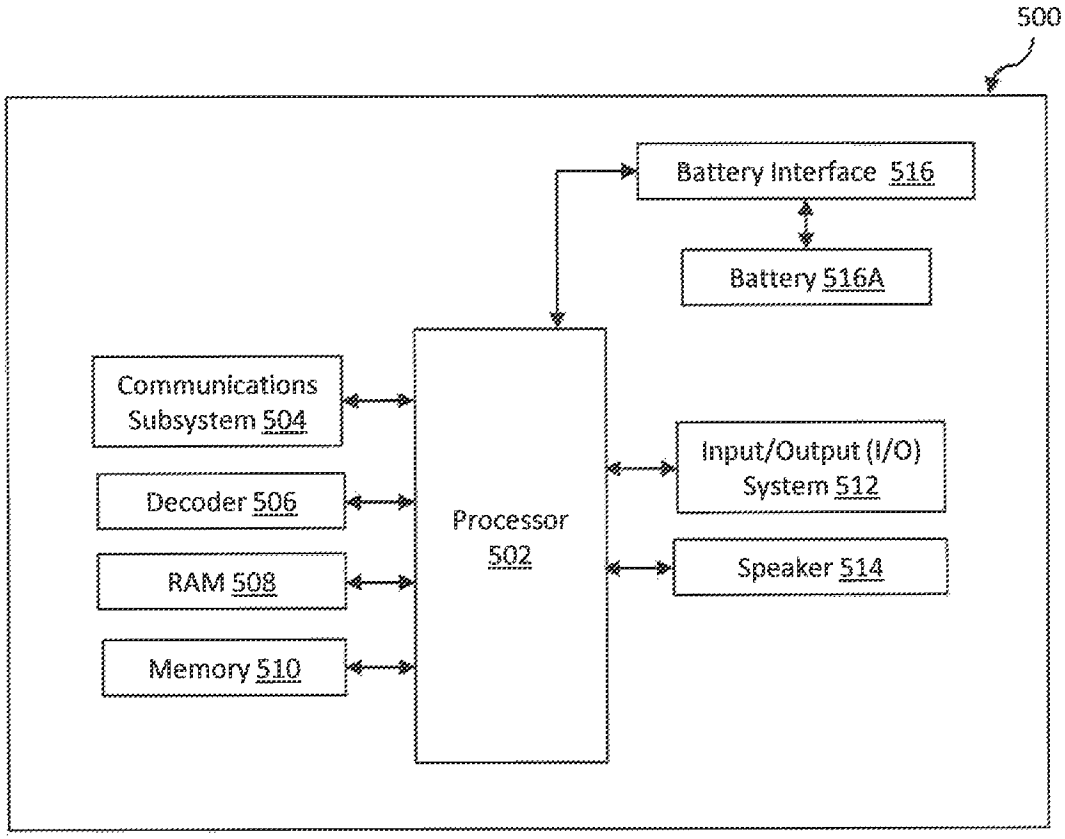
FIG. 5 is a diagram of an exemplary beacon device, consistent with the disclosed embodiments.

In some embodiments, wireless communications environment 100 may also include a "beacon" device capable of presenting an alert to first responders without possessing the voice and data communication capabilities characteristic of smart phones, mobile telephones, and other wireless communications devices. FIG. 5 illustrates an exemplary beacon device 500 consistent with disclosed embodiments. In certain instances, beacon device 500 may correspond to one or more of client devices 102 and 104, and may be capable of executing software instructions to perform processes consistent with the disclosed embodiments, such as those described above in reference to FIG. 3.

In an embodiment, beacon device 500 may represent a computer-based device that includes a processor 502 controlling an overall operation of beacon device 500, a communication subsystem 504 operable to receive data broadcast across wireless network 130 via base station 120 (and/or mobile cellular site 122), and a decoder 506 that decompresses and decrypts data received by communications subsystem 504. In some embodiments, beacon device 500 may represent a battery-powered device, and may include a battery interface 516 for receiving a corresponding battery 516A.

In FIG. 5, processor 502 is communicatively coupled to and can interact with a random access memory (RAM) 508 and a memory 510. In one embodiment, memory 510 may store an operating system and code that are executed by processor 502. Memory 510 may also store information identifying one or more device settings associated with the presentation of audible, visual, or tactile alerts specified by a beacon message.

Processor 502 may also be coupled to and can interact with an input/output (I/O) subsystem 512 and a speaker 514. In one embodiment, I/O subsystem 512 may include may include a switch enabling a corresponding user to activate or deactivate beacon device 500. I/O subsystem 512 may include a visual indicator unit that, in certain aspects, illuminates and/or flashes upon receipt of data by communications subsystem 504. Visual indicator units consistent with the disclosed embodiments may include a LCD display, one or more LEDs, one or more incandescent lamps, one or more fluorescent lamps, and any combination thereof.

In certain embodiments, and described above in reference to FIG. 3, beacon device 500 may be disposed on or proximate to an individual within a geographic region impacted by a mass-casualty event (e.g., a natural disaster or a terrorist event). Due to the mass-casualty event, the individual may be incapacitated and further, may be trapped in a collapsed or partially-collapsed structure within the geographic region. As described above, the first responders may deploy one or more multi-carrier mobile cellular sites within the geographic region to communicate with one or more wireless devices disposed proximate to the trapped and/or incapacitated individuals, and cause the wireless devices to generate and present an audible and/or visual alert assisting the first responders in search and rescue operations.

For example, upon deployment and activation of a mobile cellular site (e.g., mobile cellular site 122), beacon device 500 may detect a control signal broadcast by mobile cellular site 122 (e.g., step 302 of FIG. 3) and may establish communications and register with mobile cellular site 122 (e.g., step 304 of FIG. 3). In some embodiments, beacon device 500 may establish communications and register with mobile cellular site 122 in accordance with one or more registration protocols associated with a manufacturer of beacon device 500 or mobile cellular site 122.

Beacon device 500 may, in certain embodiments, receive a beacon message broadcast by mobile cellular site 122 (e.g., step 306 of FIG. 3) and may obtain one or more device settings associated with audible, visual, and/or tactile alerts specified by the beacon message (e.g., step 308 of FIG. 3). In one embodiment, processor 502 may obtain the device settings from memory 510, and additionally or alternatively, processor 502 may parse the beacon message to obtain the device settings (e.g., from a header associated with the message or from a body of the message).

Beacon device 500 may generate and present an audible alert, and additionally or alternatively, a visual alert, in accordance with the obtained device settings (e.g., step 310 of FIG. 3). In one embodiment, processor 502 may cause speaker 514 to emit a continuous tone having a corresponding predetermined frequency of combination of frequencies at a maximum possible volume of beacon device 500. Additionally or alternatively, processor 502 may cause the visual indicator unit to flash at periodic intervals (e.g., once every thirty seconds). Further, beacon device 500 may continuously emit the audible alert and display the visual alert until acknowledged by one of the first responders, or alternatively, until battery 516A discharges.

In one aspect, beacon device 500 may determine whether the first responder acknowledges the generated alert or alerts (e.g., step 312 of FIG. 3). By way of example, a first responder may locate and rescue a victim associated with beacon device 500. In such an instance, the first responder may press the power button associated with I/O unit 512 of beacon device 500 in order to acknowledge the generated alert or alerts. If beacon device 500 determines that the first responder acknowledges the generated alert or alerts, beacon device 500 may deactivate the generate alert (e.g., step 314 of FIG. 3).

In an embodiment, a governmental or administrative entity may purchase and distribute one or more of beacon device 500 to groups of individuals who might be vulnerable during a mass casualty event, and further, who might not have access to fully-functional wireless devices (e.g., wireless device 102). By way of example, students may be prohibited from possessing wireless devices which at school, and a local school board or school administration may distribute beacon devices 500 to students of various ages and grades in order to provide an alert to first responders during a mass casualty event. In some embodiments, in anticipation of the mass casualty event, school personnel may activate beacon devices 500 to students prior o evacuation and/or sheltering in place.

In other embodiments, a government entity may distribute beacon device 500 to prisoners incarcerated in correctional facilities (e.g., jails, penitentiaries, or halfway houses). By way of example, one or more of beacon devices 500 may be activated and distributed in anticipation of a mass casualty event, or alternatively, beacon device 500 may be incorporated as a component of a monitoring bracelet affixed about an extremity of a prisoner (e.g., a non-removable ankle bracelet).

In further embodiments, a medical facility (e.g., a hospital, nursing home, or hospice) may distribute beacon device 500 to patients in anticipation of a mass casualty event, or alternatively, upon admission into the medical facility. By way of example, beacon device 500 may be incorporated into an identification bracelet issued to a patient upon admission and affixed about a wrist of the patient.

In certain aspects, beacon device 500 may include a fastening mechanism (e.g., an alligator clip, a pin, and/or a hook) that enables an individual to attach beacon device 500 to an article of clothing, a purse, or a backpack. Additionally or alternatively, beacon device 500 may be incorporated into a wristwatch or bracelet secured about an individual's wrist, a headband placed on an individual's head, or within a pendant secured about an individual's neck using a corresponding chain or necklace. In other aspects, beacon device 500 may be incorporated as a component in a wearable computing device, such as a wearable eyewear-based computing device.

Further, in some embodiments, beacon device 500 may be embedded within an article of clothing worn by an individual within a geographic region potentially impacted by a mass casualty event. For example, beacon device 500 may be incorporated into a midsole portion of an athletic shoe, which may be worn by students in primary and secondary schools, or embedded into a portion of a uniform of a school, correctional facility, medical facility, or other governmental or non-governmental institution.

In other embodiments, beacon device 500 may be incorporated into a collar or other tag affixed to an animal. For example, an owner of a dog or cat may affix beacon device 500 onto a portion of a corresponding collar. Upon activation by mobile cellular site 122 beacon device 500 may generate an audible and/or visual alert that identifies a location of the dog or cat to a first responder, or alternatively, to the owner. In certain aspects, upon receipt of a beacon signal transmitted by mobile cellular site 122, beacon device 500 may emit a first audible tone indicating a trapped human victim, and further, may emit a second audible tone indicating a trapped animal. By way of the example, a frequency of the first audible tone may differ from that of the second audible tone (e.g., a high-pitch audible tone many signal a presence of a trapped human, and a low-pitch audible tone may signal a presence of a trapped animal).

Furthermore, and as described herein, one or more of wireless device 102 and beacon device 500 may be configured to emit an audible tone indicative of a trapped and/or incapacitated individual. In an embodiment, the audible tone may be characterized by a single frequency, or by a number of alternating frequencies, that fall within a range of frequencies audible to a human being. In other embodiments, however, one or more of wireless device 102 and beacon device 500 may be configured to emit a tone at a frequency audible to canines or other animals that may assist a first responder in search and rescue operations.

Using the embodiments disclosed above, first responders may deploy multi-carrier, mobile cellular sites within a geographic region impacted by a mass casualty event to establish communications with and register one or more wireless devices (e.g., client devices 102 and 104 or beacon device 500) associated with individuals trapped in a damaged structure. In some embodiments, the first responders may broadcast a beacon message to the registered wireless, and the beacon message may cause the registered wireless devices to generate an audible and/or visual alert indicative of a position of the trapped individuals within the structure. First responders, in such instances, may search and rescue operations within the structure to efficient locate and rescue the trapped individuals.

In some embodiments, the mass casualty event may impact a number of structures within a geographic region. For example, a large tornado may travel across a large geographic region and damage structures in several towns and communities. Prior to initiating search and rescue operations, first responders must assess the damaged structures and determine what damaged structure, or group of damaged structures, serve as an initial focus of the search and rescue operations. In certain aspects, the first responders may have limited knowledge of and information relating to concentrations of trapped victims in various damaged structures, and first responders may rely only on educated guesses to identify damaged structures on which to focus their initial search and rescue operations (e.g., a heavily damaged small office building might trap larger numbers of critically injured patients than a mildly damaged larger office building).

In an embodiment, one or more of the multi-carrier mobile cellular sites (e.g., mobile cellular site 122) may include a computer-based system (e.g., system 160) capable of executing software instructions to map spatial positions of wireless devices (e.g., client devices 102 and 104 and/or beacon device 500) associated with individuals trapped in damaged structures within an impacted geographic region, and to generate metrics indicative of numbers of trapped victims within corresponding ones of the damaged structures. In certain aspects, the first responders may leverage the generated metrics to identify one or more of the damaged structures as an initial focus of search and rescue operations, and further, to identify a "roadmap" of structures for subsequent search and rescue operations.

Figure 6:
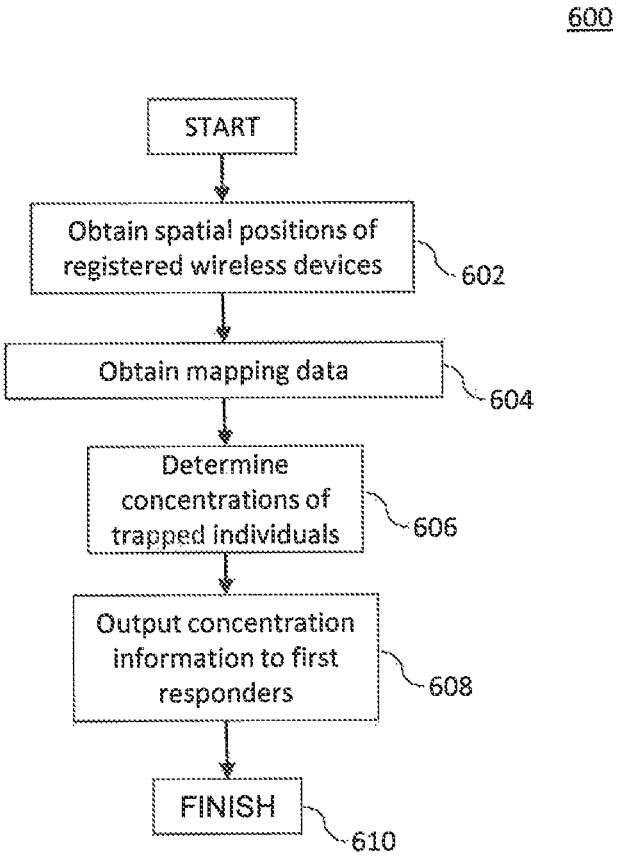
FIG. 6 is a flow diagram of an exemplary method for identifying victims trapped by damaged structures within a geographic region, consistent with the with disclosed embodiments.

FIG. 6 is a flowchart of example method 600 for identifying concentrations of individuals victims trapped within structures damaged by a mass casualty event, in accordance with disclosed embodiments. Exemplary method 600 provides functionality that, in an embodiment, enables a computer system associated with a mobile cellular site (e.g., system 160 of FIG. 1) to identify spatial positions of registered wireless devices and further, to determine numbers of trapped individuals within damaged structured disposed within a geographic region impacted by the mass casualty event. By way of example, the mass casualty event may include, but is not limited to, a natural disaster (e.g., a tornado, an earthquake, a flood, a forest fire, or a tsunami), a terrorist attack, an industrial accident, a criminal event, and any additional or alternate event may trap individuals in structures or incapacitate individuals within these structures.

In certain aspects, as described herein, system 160 may include or may be in communication with a wireless device associated with a first responder to the mass casualty event. By way of example, the wireless device of the first responder may include, but is not limited to, a smartphone, tablet computer, or wearable computing device (e.g., a smartwatch). In some embodiments, the functionality of exemplary method 600 may be implemented by an executable program or application (e.g., a mobile "app") executed by the wireless device of the first responder.

Referring to FIG. 6, in step 602, system 160 obtains information identifying spatial positions of wireless devices (e.g., beacon device 500, wireless device 102, and/or wireless device 104) registered and in communication with mobile cellular site 122. In one embodiment, mobile cellular site 122 may identify the spatial positions of the wireless devices in step 602 by "pinging" the registered wireless devices. For example, as described herein, wireless device 102 may include a positioning subsystem (e.g., positioning subsystem 218), and mobile cellular site 122 may "ping" wireless device 102 to request information identifying a current spatial position. Positioning subsystem 218 may determine the current spatial position of wireless device 102 (e.g., a longitude, latitude, and/altitude), and communication subsystem 204 may transmit the determined spatial position to mobile cellular site 122 as a response to the "ping."

The disclosed embodiments are not limited to techniques by which a mobile cellular site 122 "pings" registered devices to obtain positioning information. For example, beacon device 500 may possess limited functionality and may not include a positioning subsystem. In an embodiment, first responders may obtain spatial positions of registered wireless devices in step 602 through a triangulation process.

In certain aspects, first responders may deploy multiple mobile cellular sites within the geographic region impacted by the mass casualty event, and these mobile cellular sites may, upon activation by first responders, attempt to establish communications within multiple wireless devices (e.g., beacon device 500 and/or client devices 102 and 104) disposed within the impacted geographic region. In an embodiment, system 160 may receive data from the multiple mobile cellular sites in step 602, and based on the received data, may compute triangulated positions of the registered wireless devices within the impacted geographic region. By way of example, system 160 may receive data indicating of a signal strength and a lag time associated with signals transmitted between beacon device 500 and each of the multiple mobile cellular sites, and may compute the spatial position of beacon device 500 in step 602 based on a comparison of the received signals strengths and lag times.

Referring back to FIG. 6, system 160 may obtain mapping data associated with the geographic region in step 604. In an embodiment, the obtained mapping data may include topographical details of the impacted geographic region, one or more streets that traverse the impacted geographic region, and further, positions of the one more structures disposed within the geographic region. Further, by way of example, the mapping data may also provide structural and/or occupancy information for the structures (e.g., a square footage, a number of floors, representative tenants, etc.).

In step 606, system 160 may process the obtained spatial positions and mapping data to determine concentrations of individuals trapped within the structures of the impacted geographic region. In certain aspects, system 160 determines that an individual is trapped within a structure based on a spatial position of a corresponding wireless device, which may be disposed proximate to the individual or may be attached to the individual or the individual's clothing In one embodiment, the obtained mapping data may specify spatial positions of the structures within the impacted geographic position, and system 160 may determine that a wireless device is disposed within a corresponding structure when a spatial position of that wireless device falls within a threshold distance of a spatial position of the structure. In further embodiments, the obtained mapping data may specify spatial boundaries for the structures in the geographic region, and system 160 may determine that a wireless device is disposed within a corresponding structure when a spatial position of that wireless device fails within the boundaries of the corresponding structure.

In step 608, system 160 may provide information that identifies concentrations of individuals trapped within corresponding ones of the structured within the impacted geographic region. For example, system 160 may provide a textual listing of the structures and corresponding numbers of trapped individuals. Additionally or alternatively, system 160 may generate a graphical representation that, with the obtained mapping data, provides visual indicators of a number of individuals trapped within corresponding ones of the structures. In an embodiment, the graphical representation may be rendered by system 160 for display to the first responders on a corresponding display screen. For example, a color of an indicator displayed on or proximate to a structure may indicate a number of individuals potentially trapped within that structure (e.g., a red circle may indicate a large number of individuals, while a green circle may indicate relatively few trapped individuals). Additionally or alternatively, a size of the displayed indicator may be indicative of the number of trapped individuals (e.g., a large indicator would correspond to a large number of trapped individuals). Once system 160 provides the concentration information to the first providers, exemplary method 600 is complete in step 610.

In some embodiments, the first responders may leverage the provided concentration information to identify one or more structure to serve as an initial focus for search and rescue efforts. Further, upon identification of these initial structures, the alerts generated by the individual wireless devices in response to the beacon signal, as described herein, may guide the search and rescue efforts at individual ones of the structure. In certain aspects, the disclosed cellular beacons and mapping processes enable first responders to more rapidly locate injured and incapacitated individuals within damaged structures, devote additional time to the rescue and treatment of these injured and incapacitated individuals, and increase a likelihood that these injured and incapacitated individuals survive mass casualty event.

Further, in some embodiments, the first responders may leverage the provided information to not only focus initial search and rescue efforts, but to plan for subsequent search and rescue operations throughout the geographic region. By way of example, the first responders may allocate a substantial portion of available resources to search and rescue operations at the initial structures, while deploying remaining resources to other impacted structures within the geographic region. In certain aspects the provided information may enable first responders to dynamically allocate resources for search and rescue operations within the geographic region.

In some embodiments, wireless devices similar to wireless device 102, wireless device 104, and beacon device 500 may be embedded within seats of an airliner, a train, a bus, and other forms of mass transportation. In certain aspects, as described herein, the audible, visual, and/or tactile alerts generated by these embedded wireless devices may enable first responders to locate casualties resulting from a crash or other incident involving these forms of mass transportation (e.g., an airliner crash or a train derailment).

Additionally or alternatively, wireless devices similar to wireless device 102, wireless device 104, and beacon device 500 may be embedded within a life safety device, such as a life vest or a life raft, provided to passengers and crew during a shipboard emergency or accident. In some embodiments, vessels operated by a coast guard (e.g., the U.S. Coast Guard) may broadcast a beacon signal to the embedded wireless devices embedded, and the generated audible, visual, and/or tactile alerts may guide first responders in their maritime search and rescue operations.

Further, in some embodiments, one or more of wireless device 102, wireless device 104, and beacon device 500 may be embedded into equipment utilized or carried by individuals in dangerous environments. By way of example, wireless devices may be embedded within clothing, skis, and snowboards carried by individuals in regions of potential avalanche, or alternatively, within clothing worn by individuals exploring caves and other subterranean caverns. Upon activation by a corresponding beacon signals, the audible, visual, and/or tactile alerts generated by the embedded wireless devices may aid first responders in locating buried or stranded victims within these dangerous embodiments.

In additional embodiments, wireless devices similar to wireless device 102, wireless device 104, and beacon device 500 may be embedded within and communicatively coupled to on-board systems of vehicles. By way of example, a wireless device may be embedded within a dashboard of a vehicle (or alternatively, affixed/placed within a passenger or engine compartment of the vehicle) and may be communicatively coupled to the vehicle's on-board computer by a wired connection or wireless connection (e.g., a Bluetooth connection, a WiFi connection, a NFC connection). In certain aspects, upon activation by a beacon signal, the wireless device may generate a corresponding audible, visual, and/or tactile alert, and may further provide instructions to the on-board computer that cause the vehicle's lights and horn to activate periodically or continuously.

Various embodiments have been described with reference to the accompanying drawings and embodiments. It will, however, be evident that various modifications and changes may be made thereto, and additional embodiments may be implemented, without departing from the present disclosure. The specification and drawings are accordingly to be regarded in an illustrative rather than restrictive sense.

For example, advantageous results may still be achieved if steps of the disclosed methods were performed in a different order and/or if components in the disclosed systems were combined in a different manner and/or replaced or supplemented by other components. Advantageous results may still be achieved if values or data were different than explicitly disclosed. Other implementations are also within the scope of the present disclosure.

The accompanying drawings, which are incorporated in and constitute a part of this specification, illustrate one or more embodiments and together with the description, serve to explain certain aspects of the disclosed embodiments.

What is claimed is:

1. A method for providing a beacon at an electronic device, comprising:

receiving, from a mobile cellular site capable of connecting the electronic device to a network, a continuously broadcasted control signal containing a message comprising a first request to generate an audible alert and a second request to generate a tactile alert;

in response to the received message, identifying one or more first device settings that establish the audible alert and one or more second device settings that determine whether the tactile alert is a continuous vibration or a periodic vibration;

generating the audible alert in accordance with the identified first device settings, the audible alert comprising a continuous tone having a frequency detectable by a human being; and generating the tactile alert in accordance with the identified second device settings, the tactile alert comprising the determined tactile alert, wherein the audible alert and the tactile alert are generated simultaneously, wherein the mobile cellular site is located proximate to the electronic device in a geographic region impacted by a mass casualty event, and wherein the identifying comprises obtaining at least one of the first device settings from a portion of the received message.

2. The method of claim 1 , wherein the identifying comprises obtaining at least one of the first device settings from a storage device associated with the electronic device.

3. The method of claim 1, wherein the first device settings specify at least one of (i) a volume at which the electronic device generates the continuous tone or (ii) the frequency of the continuous tone.

4. The method of claim 1, further comprising:

identifying one or more device settings specified by a user of the electronic device; and modifying the user-specified device settings to conform with corresponding ones of the first device settings.

5. The method of claim 1, wherein:

the received message comprises a third request to generate a visual alert; and the method further comprises:

identifying one or more third device settings that establish the visual alert; and generating the visual alert in accordance with the third device settings, the visual alert being generated simultaneously with the audible alert.

6. The method of claim 5, wherein generating the visual alert further comprises displaying the visual alert on a display unit of the electronic device.

7. The method of claim 1, further comprising:

receiving information indicative of an acknowledgment of the audible alert; and discontinuing the audible alert in response to the received acknowledgment.

8. An electronic device, comprising:

a storage device; and at least one processor coupled to the storage device, the storage device storing software instructions for controlling the at least one processor when executed by the at least one processor, the at least one processor being operative with the software instructions and configured to:

receive, from a mobile cellular site capable of connecting the electronic device to a network, a continuously broadcasted control signal containing a message comprising a first request to generate an audible alert and a second request to generate a tactile alert;

in response to the received message, identify one or more first device settings that establish the audible alert and one or more second device settings that determine whether the tactile alert is a continuous vibration or a periodic vibration;

generate the audible alert in accordance with the identified first device settings, the audible alert comprising a continuous tone having a frequency detectable by a human being; and generate the tactile alert in accordance with the identified second device settings, the tactile alert comprising the determined tactile alert, wherein the audible alert and the tactile alert are generated simultaneously, wherein the mobile cellular site is located proximate to the electronic device in a geographic region impacted by a mass casualty event, and wherein the at least one processor is further configured to obtain at least one of the first device settings from a portion of the received message.

9. The electronic device of claim 8, wherein the at least one processor is further configured to obtain at least one of the first device settings from a storage device associated with the electronic device.

10. The electronic device of claim 8, wherein the first device settings specify at least one of (i) a volume at which the electronic device generates the continuous tone or (ii) the frequency of the continuous tone.

11. The electronic device of claim 8, wherein the at least one processor is further configured to:

identify one or more device settings specified by a user of the electronic device; and modify the user-specified device settings to conform with corresponding ones of the first device settings.

12. The electronic device of claim 8, wherein:

the received message comprises a third request to generate a visual alert; and the at least one processor is further configured to:

identify one or more third device settings that establish the visual alert; and generate the visual alert in accordance with the third device settings, the visual alert being generated simultaneously with the audible alert.

13. The electronic device of claim 12, wherein:

the electronic device further comprises a display unit coupled to the at least one processor; and the at least one processor is further configured to display the visual alert on the display unit.

14. The electronic device of claim 8, wherein the at least one processor is further configured to:

receive information indicative of an acknowledgment of the audible alert; and discontinue the audible alert in response to the received acknowledgment.

15. A tangible, non-transitory computer-readable medium storing instructions that, when executed by at least one processor, perform a method for providing a wireless beacon at an electronic device, the method comprising the steps of:

receiving, from a mobile cellular site capable of connecting the electronic device to a network, a continuously broadcasted control signal containing a message comprising a first request to generate an audible alert and a second request to generate a tactile alert;

in response to the received message, identifying one or more first device settings that establish the audible alert and one or more second device settings that determine whether the tactile alert is a continuous vibration or a periodic vibration;

generating the audible alert in accordance with the identified first device settings, the audible alert comprising a continuous tone having a frequency detectable by a human being; and generating the tactile alert in accordance with the identified second device settings, the tactile alert comprising the determined tactile alert, wherein the audible alert and the tactile alert are generated simultaneously, wherein the mobile cellular site is located proximate to the electronic device in a geographic region impacted by a mass casualty event, and wherein the at least one processor is further configured to obtain at least one of the first device settings from a portion of the received message.

* * * * *